United States Patent [19]

Reed et al.

[11] 3,954,385

[45] May 4, 1976

[54] AIR POWERED SMOKELESS FLARE

[75] Inventors: Robert D. Reed; Roger K. Noble; Robert E. Schwartz, all of Tulsa, Okla.

[73] Assignee: John Zink Company, Tulsa, Okla.

[22] Filed: Feb. 24, 1975

[21] Appl. No.: 552,423

[52] U.S. Cl. ..... 431/202; 431/350; 23/277 C; 239/430

[51] Int. Cl.[2] ..... F23D 15/00

[58] Field of Search ..... 431/202, 283, 284, 350; 23/277 C; 239/430, 431

[56] References Cited

UNITED STATES PATENTS 3,817,695 6/1974 Reed et al. ..... 431/202

*Primary Examiner*—Carroll B. Dority, Jr

*Attorney, Agent, or Firm*—Head & Johnson

[57] ABSTRACT

This is an improved smokeless flare powered by air supply to the burner at substantial velocity. The flare includes an air flow-operated damper for the purpose of preventing the back flow of flame and hot gases under adverse wind conditions. The damper consists of two semicircular plates which are hinged along the diameter of the air supply pipe and are held in a closed (transverse) position by means of tension springs. Another feature of this flare is that in the sectors between the spider arms of the burner there are baffles which are triangular in shape and have substantial longitudinal dimension. There are narrow passages between the baffles and each of the adjacent spider arms so that the air flow from the blower must pass through these restricted passages and therefore will move at a higher velocity. A third feature involves openings through the side wall of the air flow pipe opposite the baffles so that there is induced flow of air through these openings into the baffle space and up through the triangular wall of the baffle to prevent accumulation of soot.

4 Claims, 10 Drawing Figures

AIR POWERED SMOKELESS FLARE

BACKGROUND OF THE INVENTION

In the art of smokeless flaring of smoke-prone gases, where steam for smoke suppression is not available, it is common to use air powered flares, where blowers supply air as required.

Such flares, whether vertically or horizontally oriented, have a serious fault in that at times the effects of wind turbulence, or wind impact, cause movement of flame and hot gases from the normal burning area, downstream of the burner, in an inverted direction, through the air tube between the burning area and the blower, which is typically motor-driven. This may cause serious heat damage to both blower and motor. Flares have been made inoperable in such cases.

Where the flare is horizontally oriented, and where the blower induced air flow velocity from the blower over the burner is of the order of 83 fps, for discharge countercurrent to wind action, where the wind action may be at a velocity of 88 feet/second (60 MPH) which is not at all uncommon, the wind impact pressure exceeds the blower air discharge pressure and in this case forces the flame and hot gases from the normal burning area back through the air tube and into contact with the blower and motor.

SUMMARY OF THE INVENTION

It is a primary object of this invention to provide a flare for smokeless combustion of gases using the power of combustion air flow to provide turbulence and mixing to obtain complete smokeless combustion.

It is a further object of this invention to provide means for preventing the back-flow of flame and hot gases due to wind flow conditions so that the flame is driven back along the air supply tube to the blower and the electrical equipment, etc.

It is still further an object of this invention to provide a series of baffles in triangular shape placed between adjacent spider arms of the burner so as to limit the space for air flow past the spider arms, to narrow channels on each side of the spider arms.

It is a still further object of this invention to provide a means for inducing air flow from the outside through openings in the wall of the air tube, and into the triangular baffles, so that there will be a continuous flow, downstream of the burner over the area of the baffle, to prevent the settling and collection of soot on the baffles.

While it is common in flare construction to use blower propelled air flow to the burner to provide the necessary turbulence and mixing to obtain complete combustion of the gas, such systems are subject to considerable difficulty particularly in the event of high wind velocity, and particularly where the wind direction is such that it has a substantial velocity component down the flare. In such cases the wind may drive the flame and hot gases upstream, past the burner and into the vicinity of the blower and the electrical equipment, causing serious damage.

These and other objects are realized and the limitations of the prior art are overcome in this invention by utilizing a flow controlled baffle in the air supply tube between the blower and the burner. This may comprise two semicircular plates which are hinged along a diameter of the pipe and are retained ina closed position by means of springs. When the blower is operating and there is substantial air flow along the air pipe, the baffle plates are moved into a position along the diametrical plane of the pipe, so that there is a minimum of obstruction to the flow of combustion air. However, when the blower is turned off or when wind impact pressure exceeds blower discharge air pressure, for example, the plates will close and block off the flow of gases in the backward direction, since the plates are held against stops in a transverse plane of the air tube.

A further feature of this invention is in the use of triangular baffles which are placed within each of the sectors between adjacent spider arms of the burner. These baffles provide passages for air flow to the burner in narrow zones on each side of the spider arms and between the walls of adjacent baffles. These passages form a small fraction of the total area of the air tube. This reduced cross-section causes a higher flow velocity of air across the spider arms, so that there can be turbulence and intimate mixing between the air and the gas issuing from the ports in the spider arms. Also, because of the higher velocity of air flow throug the spaces between the spider arms and the baffles, any counteractive wind flow would have to have a velocity higher than the velocity of airthrough these restricted areas in order to cause a net backflow of hot flame and gases, back past the burner and down toward the blower.

Another feature of these baffles is that sometimes where there are baffles in the plane of the burner, there are areas of quiet air flow and eddies. There is a consequent depositing of soot out of the flame onto the baffles. At infrequent random times there may be breaking off of particles of the soot which pass into the flame, and become heated and expelled from the flare, and may cause damage outside of the flare itself. This is prevented by providing air openings through the side wall of the air pipe opposite the triangular baffles. Thus the flow of combustion air past the baffles causes a reduction in pressure, which induces air flow from outside the air tube, through these openings, into the triangular baffles and then downstream with the burning gases. This continuous flow of air prevents the deposition of soot at the baffles.

BRIEF DESCRIPTION OF THE DRAWINGS

These and other objects and advantage of this invention, and a better understanding of the principles and details of the invention will be evident from the following description taken in conjunction with the appended drawings, in which.

DESCRIPTION OF THE PREFERRED EMBODIMENTS

Figure 1:
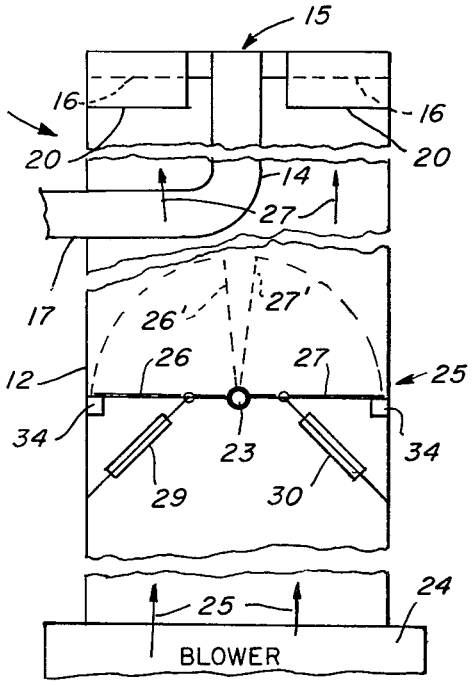
FIG. 1 is a schematic view of the combustion air supply pipe, with blower at the inlet end, flow controlled damper system, and the burner, spider arms and baffles.

Referring now to the drawings and in particular to FIG. 1 there is shown as indicated by numeral 10 the air supply structure for a gas flare embodying the improvements of this invention. In general it includes a long cylindrical tube 12, at one end of which is a blower 24 or other means for creating substantial air velocity along the tube 12, as indicated by the longitudinal arrows 25. At the downstream end of the tube 12 is a burner 15 which may be conventional, in the shape of radial spider arms 16 connected to a central axial gas pipe 14. The spider arms 16 extend substantially out to the wall 12 of the pipe. The gas flow into pipe 14 may be introduced through the side wall 12 in accordance with the pipe 17, for example. In the space between the burner assembly 15 and the blower 24 there is a damper system provided with two semicircular plates 26, 27 which are hinged about a diametral rod 23, and provided with stops 34, against which they are urged by means of springs 29, 30. In that position the counterflow of air from the burner downwards, as might be driven by wind, acts to close the baffle, and prevent any flow of hot combustion gases or flame down the air tube 12 to the vicinity of the blower, the drive motor, and electrical controls, etc. which could very well be damaged by the high temperature gases.

In the burner area there are triangular structures, or baffles, mounted between the radial spider arms. These are indicated by numerals 20, and will be described in detail in other figures.

Figure 1A:
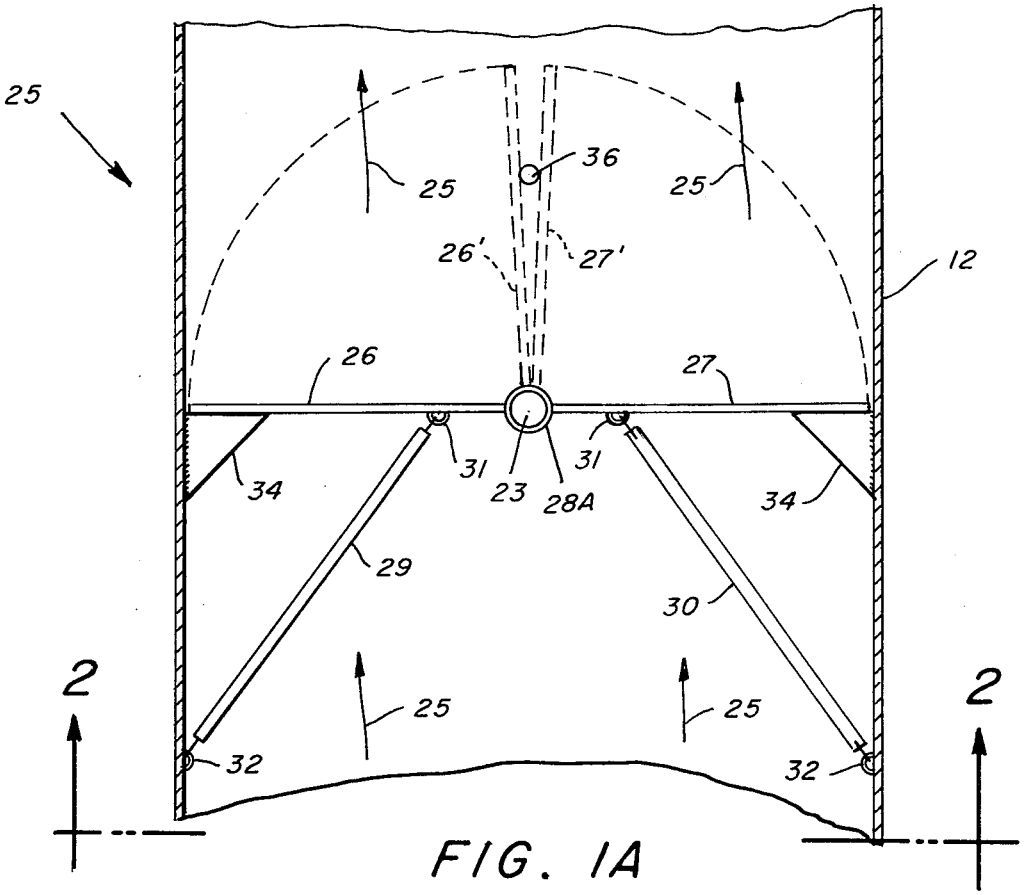
FIGS. 1A and 2 illustrate in elevation and plan views the construction of the flow controlled damper system.
Figure 2:
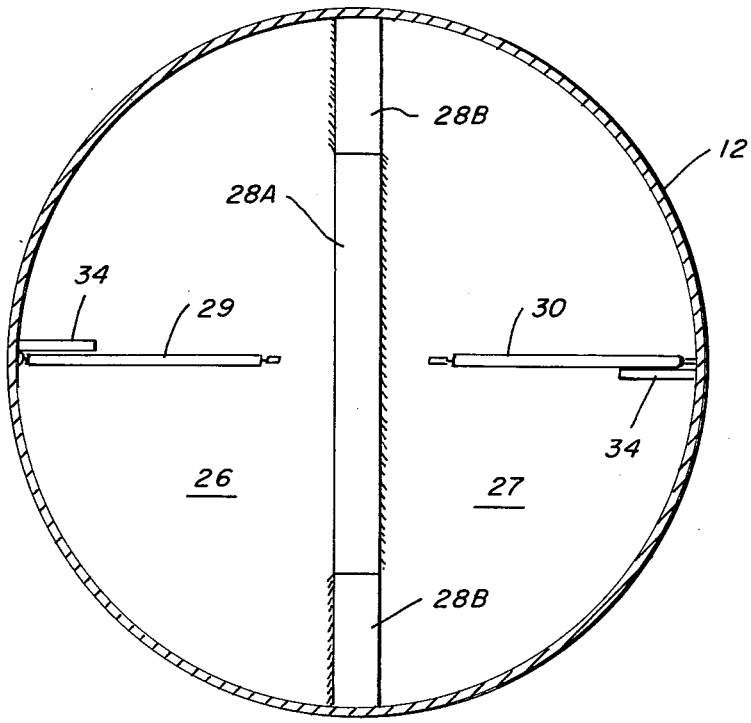

Referring now to FIG. 1A and 2 there are shown two views in cross-section of the rotatable damper system 25. There is a diametral rod, or tube 23, which is welded across the diameter of pipe 12. This rod supports two vanes constructed of semicircular plates 26, 27. These are welded to portions of tubes 28A and 28B which are freely rotatable above the rod 23, so as to form hinges about which the plates 26 and 27 can rotate. There are springs 29 and 30 which are attached to the plates at points 31—31 and attached to the wall of pipe 12 at points 32—32. These springs keep the plates in a transverse position, where they are held against stops 34 attached to the wall of the pipe.

When there is upward flow of air as indicated by the arrows 25, the pressure on the area of the plates 26 and 27 cause them to be rotated to their positions 26' and 27' where they are held against a stop 36. In this position there is substantially clear passage for air as shown by the arrows 25 from the blower up to the burner.

On the other hand, when the blower is inoperable for any reason, the plates 26 and 27 will be drawn back to their transverse position in closing off the cross-section of the air pipe 12. Thus, any wind flow down the flare to the burner cannot cause flame to pass down the air pipe to the blower and motor, etc. In the event of failure of power to the blower or in the event of a very high velocity wind, which might blow the flame down the tube 12, this rotatable damper acts to stop the flow of hot gases before they can damage the blower and electrical equipment.

Figure 3:
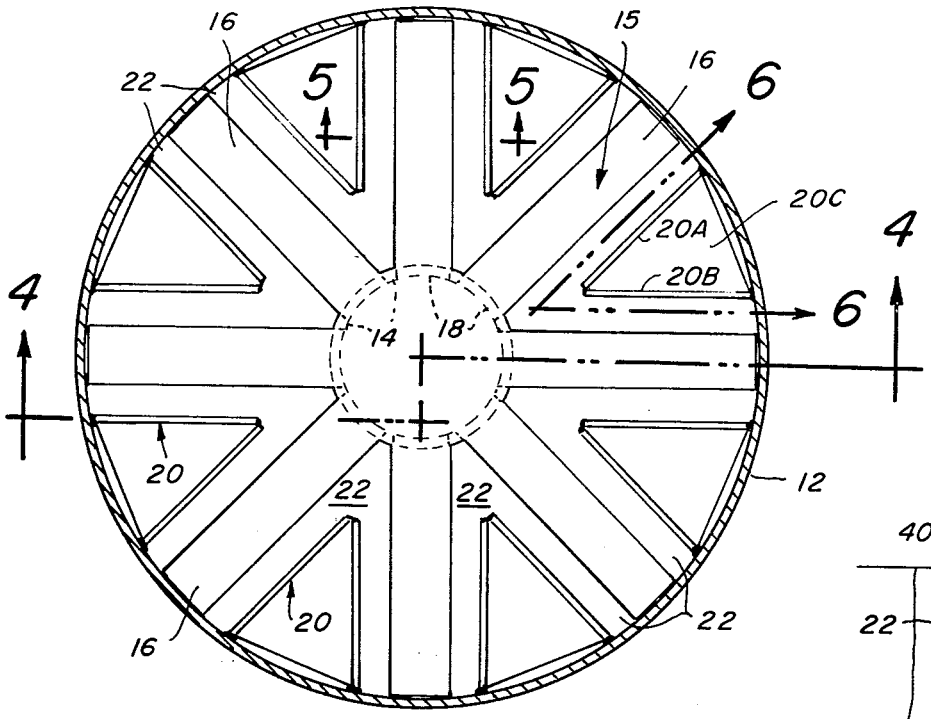
FIG. 3 is a top view of the burner with its spider arms and interarm baffles.

Referring now to FIG. 3, there is shown a top view of the burner 15 and the air supply pipe 12 which encircles the spider arms 16, of which 8 are shown in the figure, equally spaced about the gas supply pipe 14 which is shown in dashed outline. This type of burner spider arm construction is common in the prior art.

Figure 7:
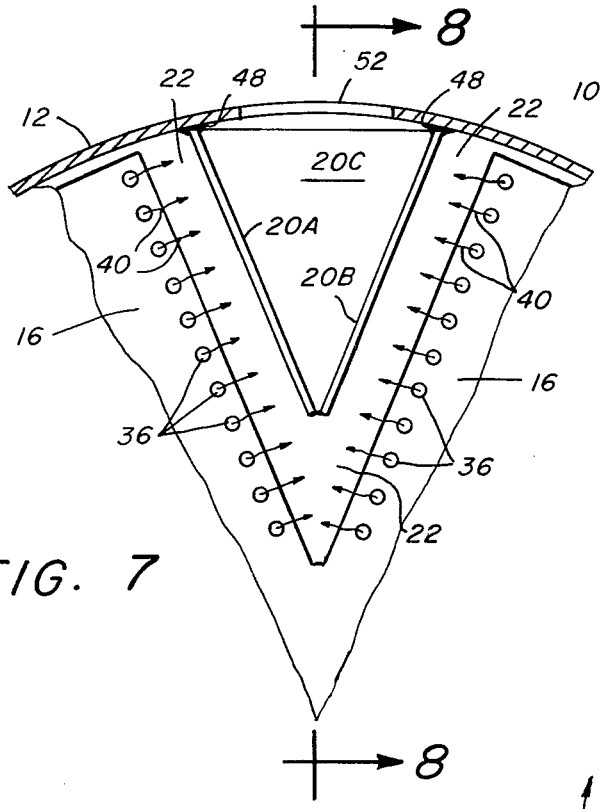
FIG. 7 is a view of a portion of FIG. 3 showing the detail of the spider arms, gas ports, and baffles.
Figure 5:
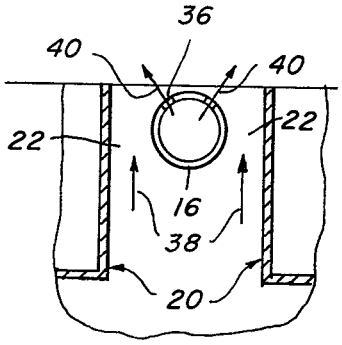
FIG. 5 is a section taken along the plane 5—5 of FIG. 3.

There are triangular baffles 20 in each of the triangular openings between pairs of spider arms. These are of such size as to close off the space for flow of air to narrow spaces 22 between the walls of the baffles 20 and the spider arms 16. The purpose of these baffles is two-fold. First of all, they serve to reduce the cross-section of the burner assembly for the direct action of wind that may cause reverse flow of hot gases and flame past the burner and down the air supply pipe. Secondly, they provide accelerated flow of air past the spider arms and the flow of gas out through the ports 36, as shown in FIGS. 4, 5 and 7, to provide intimate mixing and complete and smokeless combustion of the fuel gas.

Figure 4:
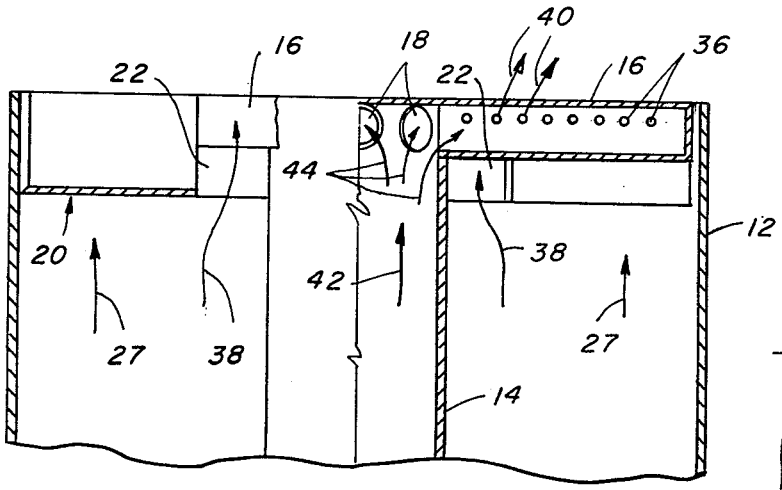
FIG. 4 is a cross-section of the burner and air supply tube taken along the section 4—4 of FIG. 3.

In FIG. 4 is shown details of the gas supply pipe 14 with upward flowing gas according to the arrow 42. The spider arms 16 are attached to the pipe 14 at its top position, where the pipes are welded over openings 18 cut through the wall of the pipe 14, so that there is flow of gas in accordance with arrows 44 into each of the radial pipes 16, where the gas flows out through ports 36 in accordance with the arrows 40.

Figure 8:
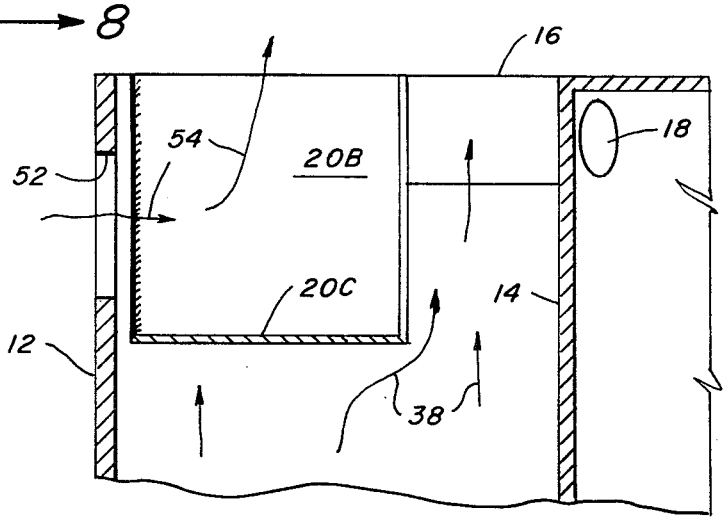
FIG. 8 shows a detail of the triangular baffles and the openings through the wall of the air tube.
Figure 9:
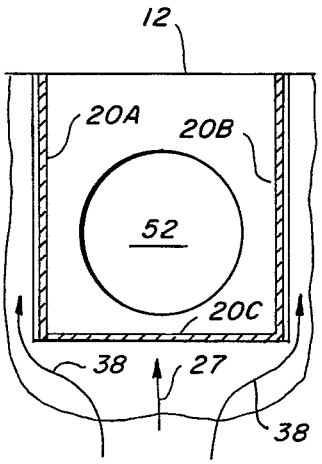
FIG. 9 shows a detail of the air openings.
Figure 6:
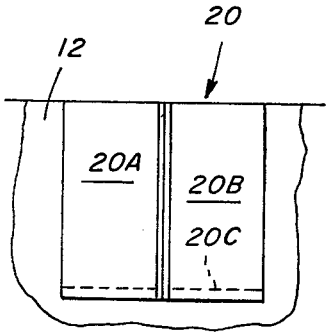
FIG. 6 is a view taken along the section 6—6 of FIG. 3.

As shown in FIG. 6, each of the baffles 20 comprises a triangular plate 20C with two rectangular plates 20A and 20B, which, with the wall of the air flow pipe 12 forms a triangular chamber, closed at the bottom, but open at the top. These triangular chambers are of substantial longitudinal extent so that they will provide flow channels 22 through which the air flows in accordance with arrows 38. Further detail of the spider arms, the gas ports 36, and the gas flow in accordance with arrows 40, and the triangular chamber baffles 20 is shown in FIGS. 7, 8 and 9.

Another feature of the invention is a plurality of openings 52 through the wall 12 of the air supply tube. These openings, which may be one or more, are in the space forming one wall of the triangular chambers 20. As shown in FIG. 8 the upflow of air in accordance with arrows 38 creates a suction inducing inward flow of atmospheric air from outside the pipe 12, through the openings 52 in accordance with arrows 54. This air moves into the combustion zone ultimately. But the primary purpose of the flow in accordance with arrows 54 is to maintain a directional flow so that there will be no settling of soot or carbon particles within the triangular chambeer 20. Where spider arm baffles have been used in the past, in the plane of the burner, there has been an experience of accumulation of soot and carbon on the downstream and internal areas of these triangular baffles, due to the eddies which form around the edges of the baffles. This accumulation of soot can be blown off under certain circumstances, which, coupled with the fact that they will pass throuh the flame zone and become ignited, and then be driven out of the flare into the atmosphere, there is possibility of fire damage to facilities outside of the flare itself. Therefore the provision of the slow moving induced air 54, as in FIG. 8, serves to keep the space above the baffles 20 clear of carbon. FIG. 9 shows a further detail of the opening 52 with relation to the walls of the chambers 20.

If the air tube 12 is substantially unobstructed from the blower to the baffle-spider assembly, the baffles sharply reduce the air flow area, to produce an equally sharp acceleration of the air flow in the baffle-spider area, to cause flow pressure drop to be greatest in the baffle-spider area. This higher air velocity better resists counter flow wind velocity, or wind pressure effect. The pressure of air or wind flow varies as $V^2/2g$. The baffles 20 form a preferred form of baffle for this purpose, but other baffle forms for identical area restriction, and provision of longitudinal air flow can be used.

However, the baffling of air flow at the burner can be a source of other difficulty, because, at the downstream face of baffling, flow interference causes eddies to form over the downstream faces of the baffles. This results in soot deposition on the downstream faces of the baffles. In the course of operation over a period of time the soot deposited accumulates significantly. When the accumulation is great enough, it may be blown off the baffle, while burning, to create a fire hazard in the environmental area of the flare.

The baffles indicated in the drawings and related structural features, provide a solution for soot accumulation. As air flow at significant velocity occurs in the baffle-spider arm area, the pressure at the downstream face of the baffle drops below atmospheric pressure in an amount equatable with the $V^2/2g$ velocity pressure of the air flow, to cause the soot to accumulate. To prevent soot accumulation it is necessary to relieve the low pressure area, to a satisfactorily degree. The openings 52 provide means for induction of air from atmospheric pressure outside the air pipe, to move into the baffle downstream area for relief of the low pressure induced by air flow velocity in the baffle-spider arm area. There is always movement of air through the baffle downstream area. For this reason, soot is prevented from depositing on the baffle surface itself. These openings 52 for induced air may be a single large opening, as shown, or a plurality of smaller openings. The ports are low in the area downstream of the baffle, to cause more effective delivery of air to the baffle downstream areas. This baffle design is preferred for reasons indicated above, since a flat baffle located in the space between spider arms, while it will accomplish the wind resistance effect substantially as well, it will be at the expense of being soot accumulation prone.

While the invention has been described with a certain degree of particularity, it is manifest that many changes may be made in the details of construction and the arrangement of components. It is understood that the invention is not to be limited to the specific embodiments set forth herein by way of exemplifying the invention, but the invention is to be limited only by the scope of the attached claim or claims, including the full range of equivalency to which each element or step thereof is entitled.

What is claimed:

1. In an air powered smokeless flare burner system, comprising:

a. a cylindrical combustion air conduit;

b. means to provide combustion air at selected velocity into a first end of said conduit;

c. fuel burner means at the second end of said conduit, said burner means comprising a gas supply pipe and a plurality of equally spaced radial spider arms in a transverse plane, and a plurality of gas ports in each of said spider arms;

the improvements comprising:

d. a plurality of baffles, one between each pair of spider arms, said baffles constructed with a triangular base in a transverse plane, and two walls respectively parallel to said adjacent pair of spider arms, said walls attached to the cylindrical wall of said conduit; and e. at least one opening through the wall of said conduit into the interior of each of said baffles;

whereby when combustion air is supplied to said first end of said conduit, it will flow along said conduit and into the spaces between said baffles and said spider arms, at high velocity, causing turbulent mixing with the gas issuing from the ports in said spider arms, and inducing a flow of outside air through said openings in the wall of said conduit, into said baffles and out of the open end of said baffles, thus inhibiting the accumulation of soot on said baffles.

2. The burner system as in claim 1 including a check valve type damper across said air flow conduit intermediate said first and second ends, said damper, comprising:

a. a pair of semicircular plates of slightly less radius than said conduit;

b. said plates independently hinged to a diametrial rod;

c. spring means to hold each of said plates in a transverse position against stops;

whereby when there is air flow through said conduit to said burner, said plates will be rotated against the force of said springs until they are substantially in a diametrial plane, and when the air flow is reduced to a small value, they will be rotated into a transverse plane by the forces of said springs.

3. In an air powered smokeless flare burner system, comprising:

a. a combustion air conduit;

b. means to provide combustion air flow at selected velocity into a first end of said conduit;

c. fuel burner means at the second end of said conduit, said burner means comprising a gas supply pipe and plurality of spider arms in a transverse plane across the cross-section of said conduit, and a plurality of gas ports in each of said spider arms;

the improvements comprising:

d. a plurality of open top baffles, between each pair of spider arms, said baffles constructed with a base in a transverse plane to said combustion air flow, and vertical walls respectively parallel to said air flow and to said adjacent pair of spider arms, said baffles attached to the cylindrical wall of said conduit; and e. at least one opening through the wall of said conduit into the interior of each of said baffles.

4. A system of claim 3 wherein:

said spider arms are radially directed from a central gas supply manifold, the improvement wherein said baffles are triangular in shape and wherein said gas ports are partially directed into the space between said arms and the corresponding baffle.

* * * * *